US005826446A

United States Patent [19]

Plath et al.

[11] Patent Number: 5,826,446

[45] Date of Patent: Oct. 27, 1998

[54] CIRCULAR KNITTING MACHINE HAVING DRIVE SYSTEM FOR YARN FEED DEVICE

[75] Inventors: Ernst-Dieter Plath, Albstadt; Harald Rehmann, Dotternhausen, both of Germany

[73] Assignee: SPIRA Patententwicklungs-und Beteiligungsge-sellschaft mbH, Albstadt, Germany

[21] Appl. No.: 839,455

[22] Filed: Apr. 14, 1997

Related U.S. Application Data

[62] Division of Ser. No. 622,760, Mar. 27, 1996.

[30] Foreign Application Priority Data

Mar. 31, 1995 [DE] Germany ..... 19511949.5

[51] Int. Cl.[6] ..... D04B 15/58

[52] U.S. Cl. ..... 66/140 R; 66/139

[58] Field of Search ..... 66/138, 139, 140 R

[56] References Cited

U.S. PATENT DOCUMENTS

| | | | |
|---|---|---|---|
| 4,404,821 | 9/1983 | Johnson et al. | 66/140 R X |
| 4,625,528 | 12/1986 | Dalmau Guell | 6/138 X |
| 4,656,842 | 4/1987 | Sawazaki et al. | 66/139 |
| 5,070,709 | 12/1991 | Guell | 66/140 R |

FOREIGN PATENT DOCUMENTS

| | | | |
|---|---|---|---|
| 2024241 | 12/1971 | Germany | 66/140 R |
| 2805779 | 8/1977 | Germany | 66/140 R |
| 481545 | 7/1980 | Spain | 66/140 R |
| 511450 | 8/1939 | United Kingdom | 66/140 |

*Primary Examiner*—John J. Calvert
*Attorney, Agent, or Firm*—Michael J. Striker

[57] ABSTRACT

The invention relates to a yarn changer for knitting machines, with swinging yarn fingers (22*c*, 22*d*), which comprise finger bodies and guide bodies (66*c*, 66*d*) having cutting and clamping elements (69, 71) slidable on the finger bodies, and with an opener (121) and closer (122) both associated with all yarn fingers in common. In order to reduce the number of moving parts and the noise occurring in operation of the yarn changer, the opener (121) and closer (122) are in such operative connection through a reverse-coupling mechanism (114–120) that they can be actuated in common by an associated cam track (102) acting on a control member (114). The control member (114) is preferably only in the working range of the cam track (102) when a yarn change is to be effected. The invention moreover concerns a knitting machine equipped with the yarn changer, especially a rib circular knitting machine, in which a yarn catcher cooperating with the yarn changer is built into the dial.

3 Claims, 16 Drawing Sheets

CIRCULAR KNITTING MACHINE HAVING DRIVE SYSTEM FOR YARN FEED DEVICE

This is a division of application Ser. No. 08/622,760 filed Mar. 27,1996.

This invention relates to a knitting machine having a yarn changer and a yarn changer useful for knitting machines.

A knitting machine of this kind has at least one support for slidably mounting knitting implements, a cam box for controlling the knitting implements and at least one yarn changer for feeding at least one selected yarn to the knitting implements. A yarn changer, also called striper, usually is provided with at least two yarn fingers which can swing to and fro between a datum position and a working position and comprise finger bodies and guide bodies having cutting elements and clamping elements and being slidably mounted on said finger bodies. The yarn changer further has a closer and an opener both common to all the yarn fingers for effecting reciprocating movement of the guide body, and means for acting on said yarn fingers, the opener and the closer in order to carry our yarn changers.

Knitting machines and yarn changers of this kind are known (EP 0 319 444 A2). These and other known knitting machines and yarn changers (DE-PS 958 237, DE 2 024 241 C3, DE 2 710 044 A1, DE 2 805 779 A1, DE 3 129 724 A1, DE 3 325 102 C2) are characterized by many individual parts, which lead to wear and proneness to faults in operation. Moreover, a problem as yet unsolved consists in that the known yarn changers are inclined to make loud rattling noises, in the form of the known clicks and rattles, on account of the constant switching movements and the many parts participating therein, even during periods in which there is actually no yarn changing taking place. Finally known circular knitting machines as fitted with yarn changers are in particular often so constructed that large parts of the working area of the machine are covered by the yarn changers, so that the normal work arising there is greatly hindered or impeded. This is very much the case when circular knitting machines with needle cylinders and dials are involved.

It is, therefore, an object of this invention to so arrange a knitting machine and a yarn changer that they consist of fewer moving parts.

A further object is to provide knitting machines having such yarn changers, particularly rib knitting machines with needle cylinders and dials, with a space-saving selector mechanism which does not substantially cover the working, area of the knitting machine.

Yet another object of this invention is to design the yarn feeder and the yarn feeder selection means such that low noise is produced during knitting.

These and other objects are solved by a knitting machine of the kind specified above wherein the opener and the closer are coupled together by a reverse-coupling mechanism controlled by a common cam track. In case of circular rib knitting machine comprising a needle cylinder and a dial for movably receiving knitting implements, a support for a dial cam box arranged above the dial, a dial drive means arranged above the support, at least one yarn changer, a selector apparatus for the yarn changer and cam tracks for actuating the functional parts of the yarn changer, the invention is characterized in that a further support for mounting the yarn changer and a support ring rotatable relative thereto for mounting the selector apparatus are arranged between the support and the dial cam box, wherein the support ring is arranged above the further support.

A yarn changer for knitting machines according to this invention comprises at least two yarn fingers which can swing between a datum position and a working position, each yarn finger having a finger body and a guide body slidably mounted thereon and having a cutting element and a clamping element. The yarn changer further comprises a closer and opener, both common to all yarn fingers, for reciprocating movement of the guide bodies, wherein the opener and the closer are operatively coupled together by a reverse-coupling mechanism.

The invention leads to the advantages that only a single control cam track is required to control the opener and closer. The number of parts is thus greatly reduced, which leads to less wear and proneness to faults. Furthermore the parts to be controlled by the selector apparatus can operate directly on the associated functional parts, instead of through intervening lever mechanisms. Moreover the invention facilitates such a design of the yarn changer that the functional parts only have to move when a yarn change is actually required, so that the usual noises largely disappear.

Further advantageous features of the invention appear from the dependent claims.

The invention will now be explained in more detail in conjunction with the accompanying drawings of embodiments, in which:

FIGS. 15 to 17 show a second embodiment of a yarn changer according to the invention in views corresponding to FIGS. 4, 3 and 13, wherein FIG. 16 is a section along the line XVI—XVI of FIG. 15;

Figure 1:
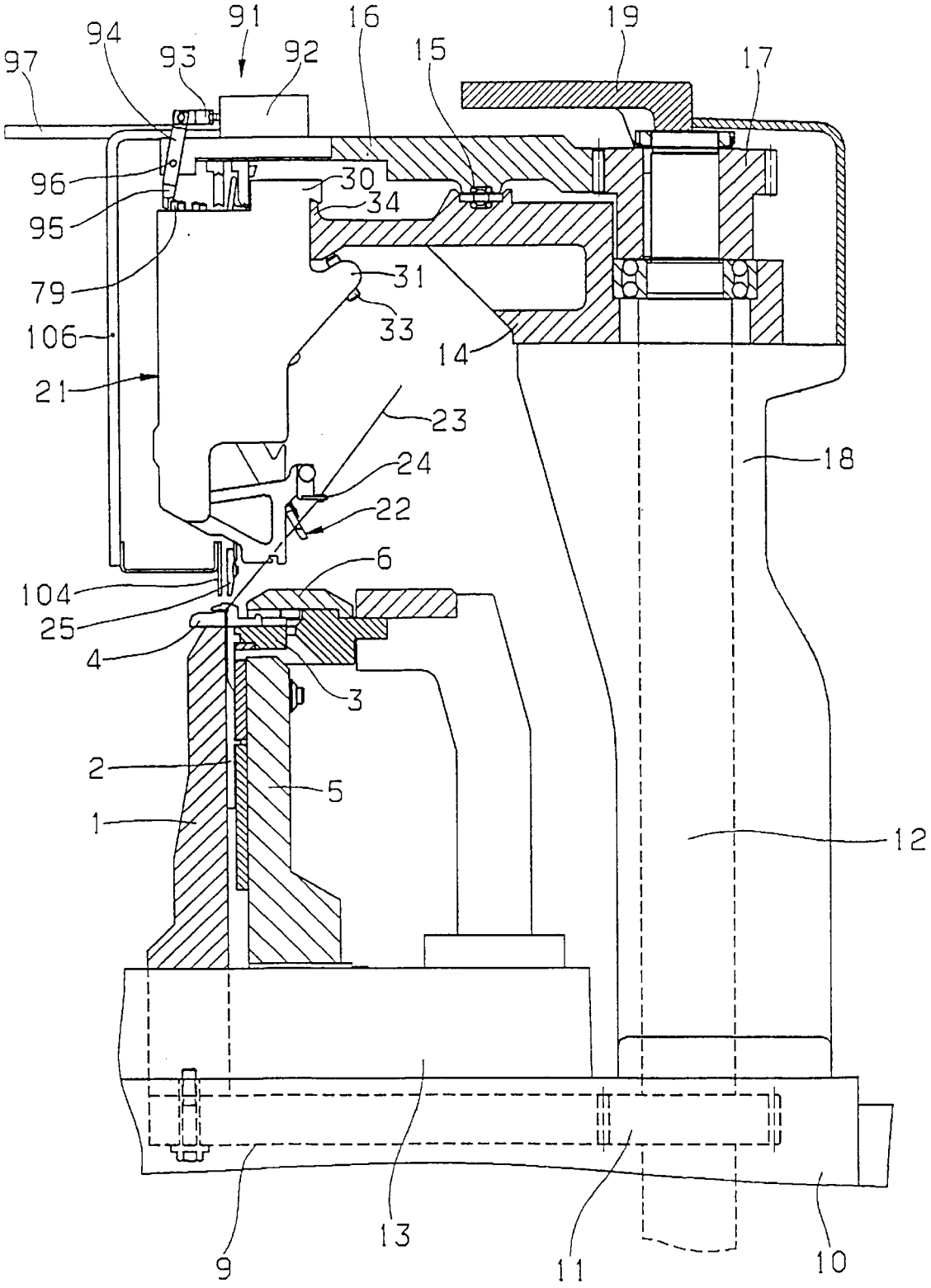
FIG. 1 is a partially cut-away side view of a circular knitting machine according to the invention.

The circular knitting machine according to FIG. 1 includes a needle cylinder 1 with a vertical axis of rotation, with knitting implements 2 mounted to move axially therein, and a coaxial sinker ring 3 with sinkers 4 mounted to move radially therein. In order to control the up and down movement of the knitting implements 2 and the radial to and fro movement of the sinkers 4, these are provided in known manner with butts, not shown, on which cam parts act; these being fitted in a cam box ring 5 surrounding the needle cylinder I and a cam ring 6 mounted above the sinker ring 3.

The needle cylinder 1 is supported coaxially on a support ring 9, which is mounted rotatably in a base plate 10 of a frame, not shown and is provided with teeth on its outer periphery. The teeth are in mesh with a gearwheel 11 which is fitted on a drive shaft 12 mounted rotatably in the frame. As against this, the cam box ring 5 and the cam ring 6 are mounted on a cam box plate 13 arranged stationary in the frame and coaxial with the needle cylinder 1. The drive shaft 12 is connected to a drive source, not shown, for the knitting machine. The arrangement can naturally also be such that the needle cylinder 1 and the sinker ring 3 are stationary, while the cam box ring 5 and the cam ring 6 are mounted rotatably in the frame and are coupled to the drive shaft 12.

An annular support 14 is fixed in position in a part of the frame lying above the needle cylinder 1 and a support ring 16 is rotatably mounted coaxial with the needle cylinder 1 on the support 14 by means of bearings 15. The support ring 14 is provided with teeth round its periphery, which mesh with a pinion 17 which is fixed on the drive shaft 12, which passes through a column 18 of the frame fixed to the support 14 and also serves to drive the support ring 16 with speed of rotation corresponding to that of the cylinder. A stationary cover ring 19 is fixed to the frame above the support ring 16. In the case in which the needle cylinder 1 is stationary, the support ring 16 is stationary, whereas the support 14 is arranged rotatably.

At least one, but preferably a plurality, of yarn changers are fixed on the support 14, each having at least two and preferably four yarn fingers 22, from each of which at least one yarn 23 can be fed from a supply spool, not shown, through a run-in eye 24, into a yarn guide 25, in order to be presented therefrom to the hooks of the knitting implements 2.

Knitting machines of this kind are generally known (e.g. EP 0 319 444 A2) and do not therefore need to be explained in more detail.

Figure 2:
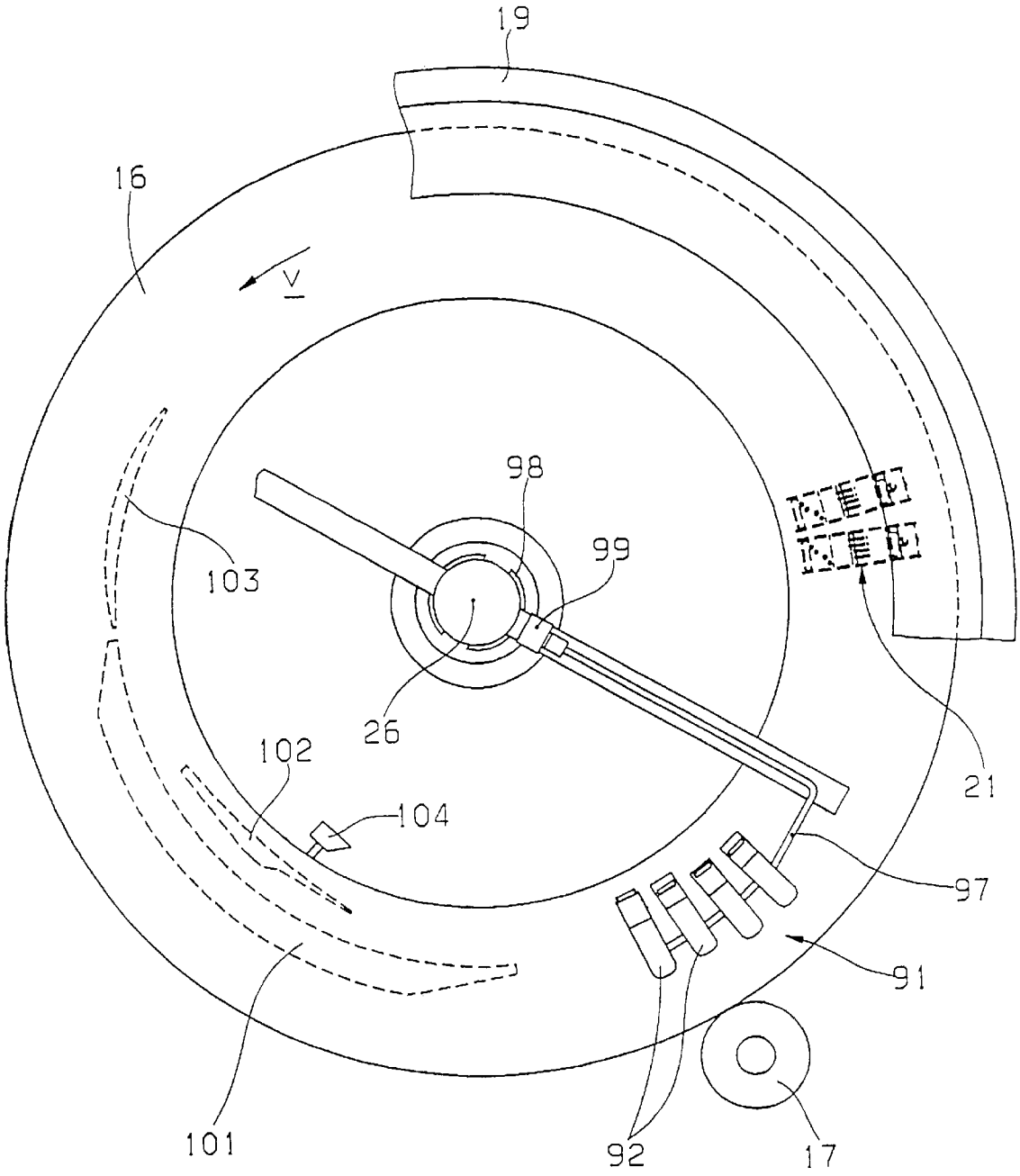
FIG. 2 is a plan view of the circular knitting machine of FIG. 1.

FIG. 2 shows first and foremost the support ring 16, the partially broken away cover ring 19 and the drive pinion 17, the axis of rotation of the support ring 16 and the needle cylinder 1, not visible, being indicated by the reference numeral 26. The parts shown in broken lines in FIG. 2 are arranged below the support ring 16, in accordance with FIG. 1. For simplicity, only two needle changers 21 are shown, which are arranged distributed with a small spacing around the axis of rotation 26 and are each associated in a manner known people with a knitting system, although fewer yarn changers 21 than knitting systems can naturally be provided.

Figure 3:
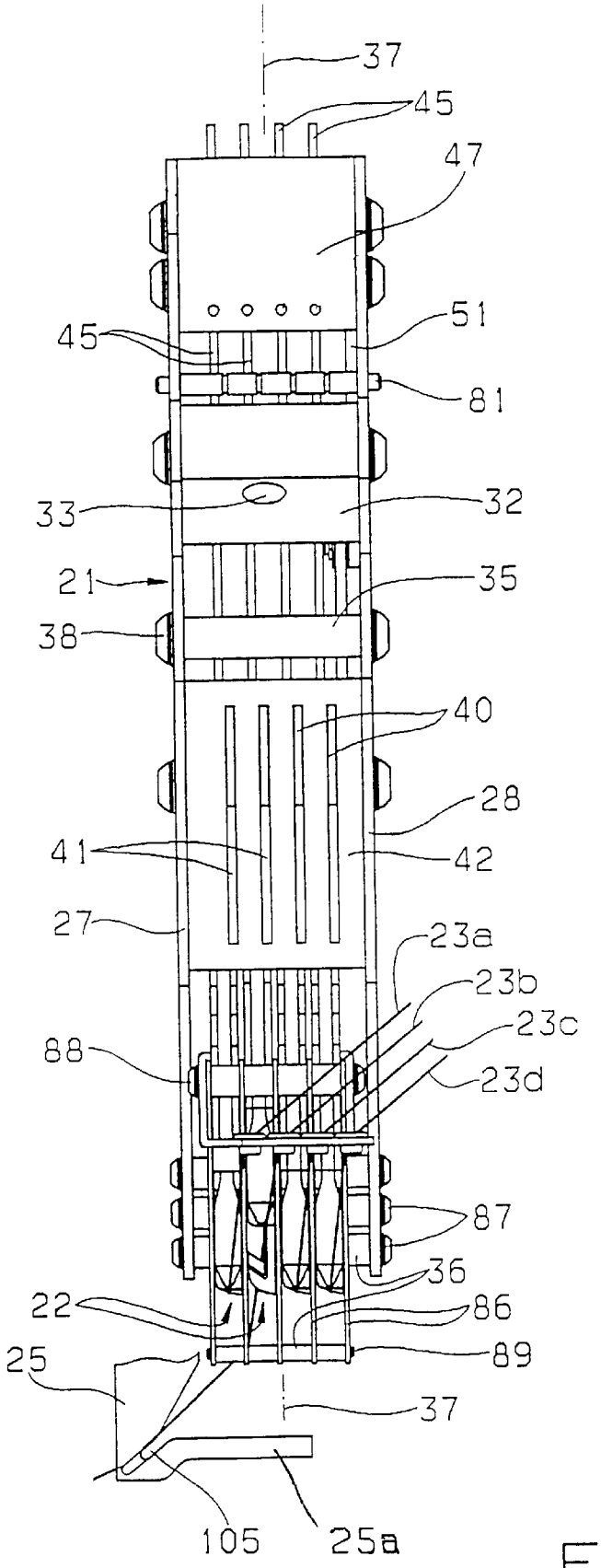
FIG. 3 is the front view of a yarn changer according to the invention.
Figure 4:
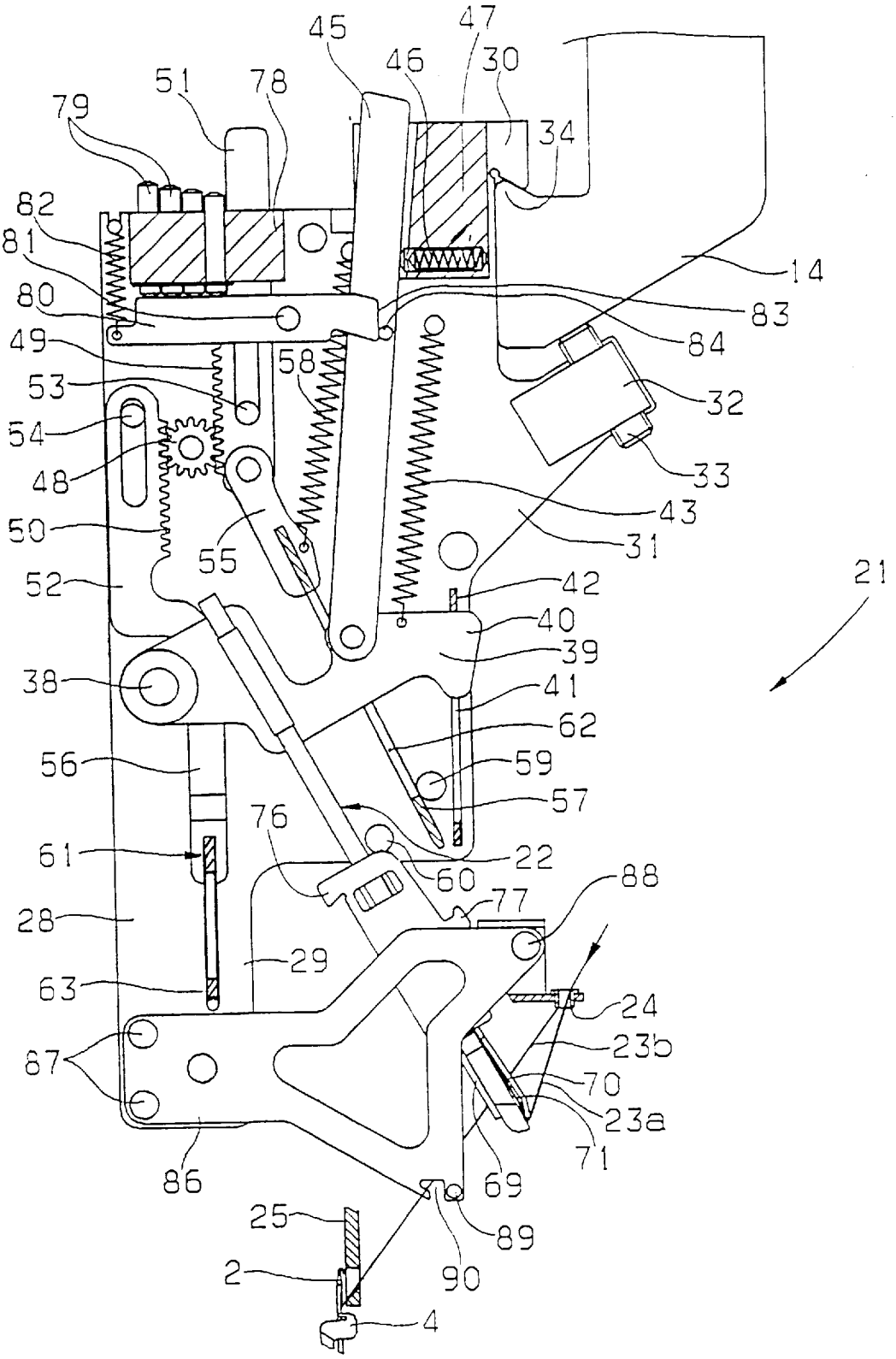
FIG. 4 is a side view of the yarn changer of FIG. 3.

According to FIGS. 3 and 4, each yarn changer 21 includes an oblong, substantially rectilinear housing formed in substance from two parallel side plates 27 and 28. The side plate 27 is removed in FIG. 4, in order to give a view of the interior of the housing. The side plates 27 and 28 have a substantially rectangular shape but are provided in a lower, front part with a cut-out 29 and in an upper, front part with extensions 30 and 31. The extensions 31 are connected by a mounting block 32, through which passes a mounting screw 33. This serves to fix the yarn changer 21 to the support 14 after hanging the extension 30 on a corresponding, surrounding projection 34 provided on the support 14. A longitudinal axis 37 (FIG. 3) of the housing is vertical, i.e. parallel to the direction of movement of the knitting implements 2 and preferably parallel to the axis of rotation of the needle cylinder 1. Moreover the side plates 27, 28 are connected together but held spaced apart by a plurality of studs or the like arranged parallel to one another and fixed to the plates by rivets or the like, with spacers 35, 36 fitted over the studs, the studs serving at the same time for pivotal mounting of other parts, as will be explained fully below.

One of the studs 38 serves for pivotal mounting of plate-form, single armed pivoted levers 39 of the yarn fingers 22. The pivoted levers 39 are provided with respective noses 40 at their front ends, which noses project into slots 41 extending parallel to the longitudinal axis 37 and formed in a plate 42 arranged transverse to the side plates 27, 28 and serve at the same time as a guide for the pivoted levers 39. The pivoted levers 39 are each so biased by a spring 43 that their noses 40 bear against the upper bounding edges of the slots 41 in a datum position.

Each pivoted lever 39 is articulated to an associated selector lever 45, which is arranged substantially parallel to the longitudinal axis 37 and above the pivoted lever 39 and whose upper end projects outwardly above the house of the yarn changer 21 in a datum position, but especially in a working position to be explained below. Each selector lever 45 is biased by a spring 46, which tends to pivot it transverse to the longitudinal direction and radially inwards with reference to the circular knitting machine according to FIGS. 1 and 2. The springs 46 in the form of compression springs are mounted in blind bores 47, which are formed in a block 48 connecting the front, upper ends of the side plates 27, 28 and are directed towards the selector levers 45. The block 48 also includes guide slots for the upper ends of the selector levers 45.

A gearwheel 48 is rotatably mounted on a further stud connecting the side plates 27, 28 and meshes with two parallel racks 49 and 50.The rack 49 is formed on the edge to the left in FIG. 4 of a control member 51 in the form of a slider and the rack 50 on the edge to the right in FIG. 4 of a slider 52. The upper end of the control member 51 projects in a datum position upwardly out of the housing of the yarn changer 21. Both sliders 51, 52 extend and are movable substantially parallel to the longitudinal axis 37 and are guided for this by suitably arranged slots on studs 53, 54. The one end of a lever 55 is articulated to the lower end of the control member 51, while the slider 52 is connected, preferably fixedly at its lower end to an arm 56. A closer 57 is fixed on the other end of the lever 55 and is normally biased radially outwards against a stop 59 by a spring 58 engaging the lever 55, but can be swung clockwise radially inwardly against the force of the spring 58, until it bears against a stop 60. On the other hand an opener 61 is fixed on the lower end of the arm 56 and is arranged always substantially parallel to the longitudinal axis 37. The spring 58 further holds the slider 51 in its uppermost position in FIG. 4 in a datum position, but holds the slider 52 in its lowermost position in FIG. 4. Moreover, the parts 48 to 54 form a reverse-coupling mechanism serving for common actuation of the closer 57 and opener 61.

The gearwheel 48, the sliders 51 and 52, the lever 55 and the arm 56 are advantageously of flat form and mounted directly against the side plate 28, so that they cannot hinder the movements of the other parts. However, the closer 57 advantageously consists of a plate arranged transversely to the lever 55 and extending over the whole width of the housing, being provided with an opening 62 through which the pivoted levers 39 pass and being fixed at one end on the lever 55. The opener 61 correspondingly consists advantageously of an angle bracket fixed on the arm 56, one limb being arranged in extension of the arm 56 and the other limb being arranged perpendicular thereto and to the side plate 28 and formed as a bar 63 extending over all the pivoted levers 45.

Figure 5:
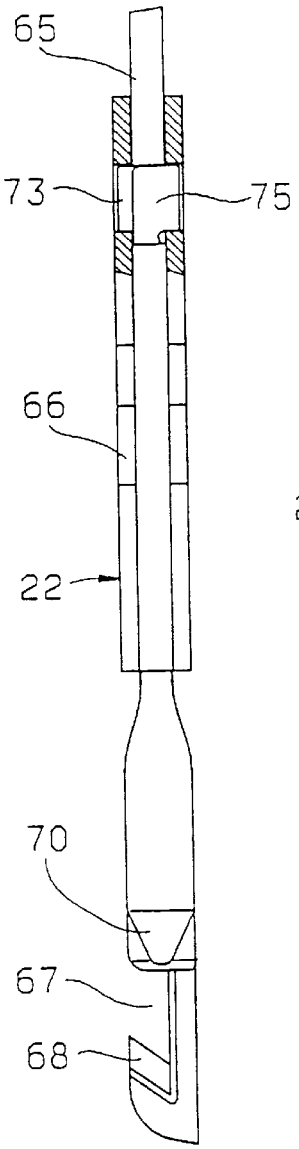
FIGS. 5 to 8 show a yarn finger of the yarn changer according to FIGS. 3 and 4 to a larger scale and with a yarn clamp open, respectively in a front view, a side view and a rear view, as well as in a cross-section.
Figure 6:
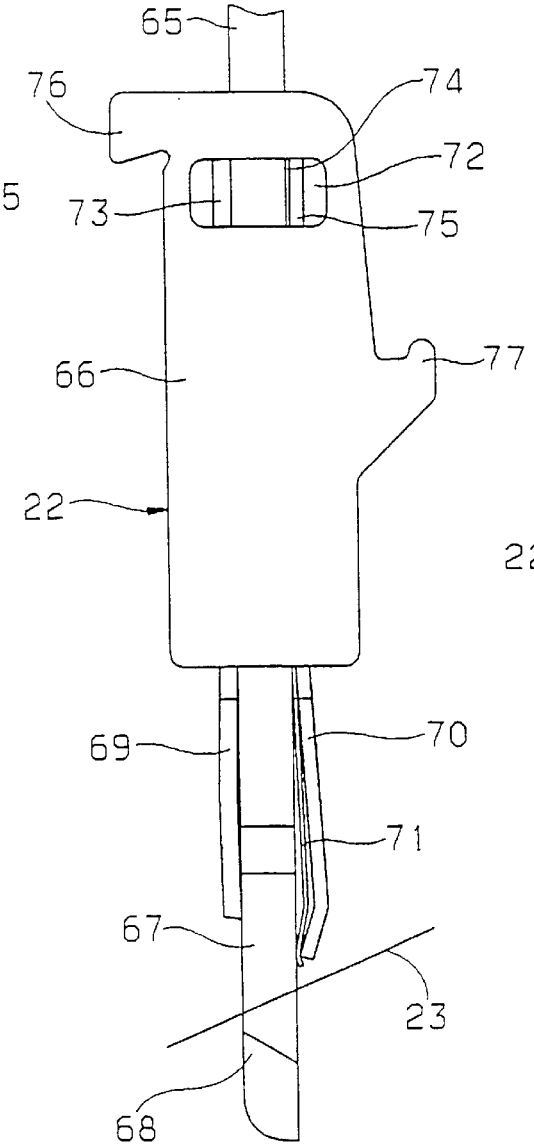
Figure 7:
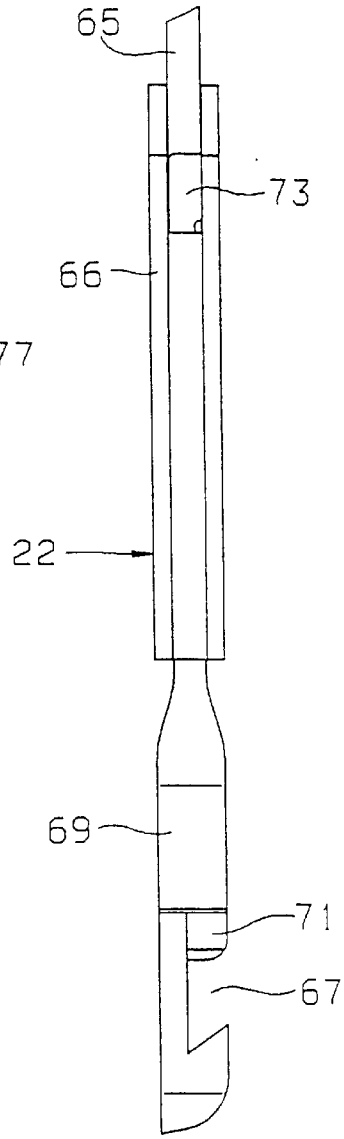
Figure 8:
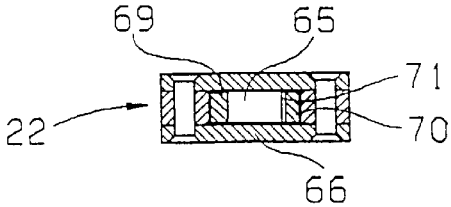
Figure 9:
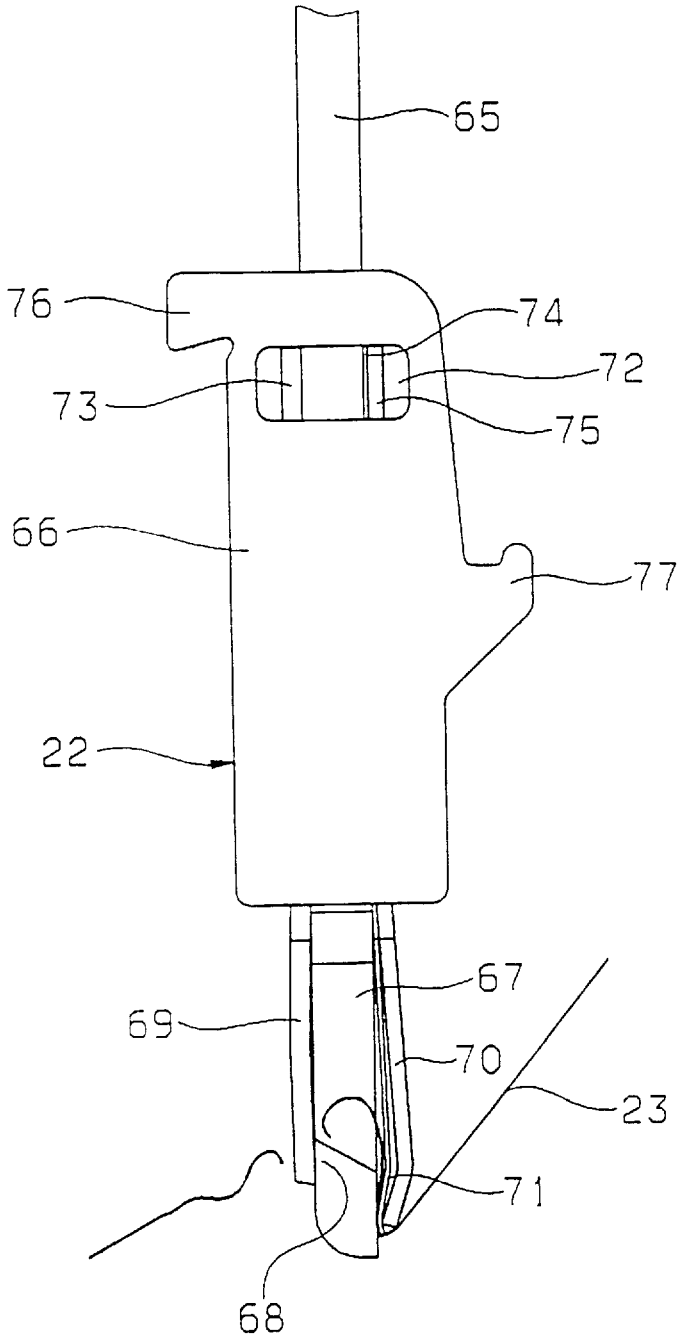
FIG. 9 is a view of the yam finger corresponding to FIG. 6, with the yarn clamp closed.
Figure 10:
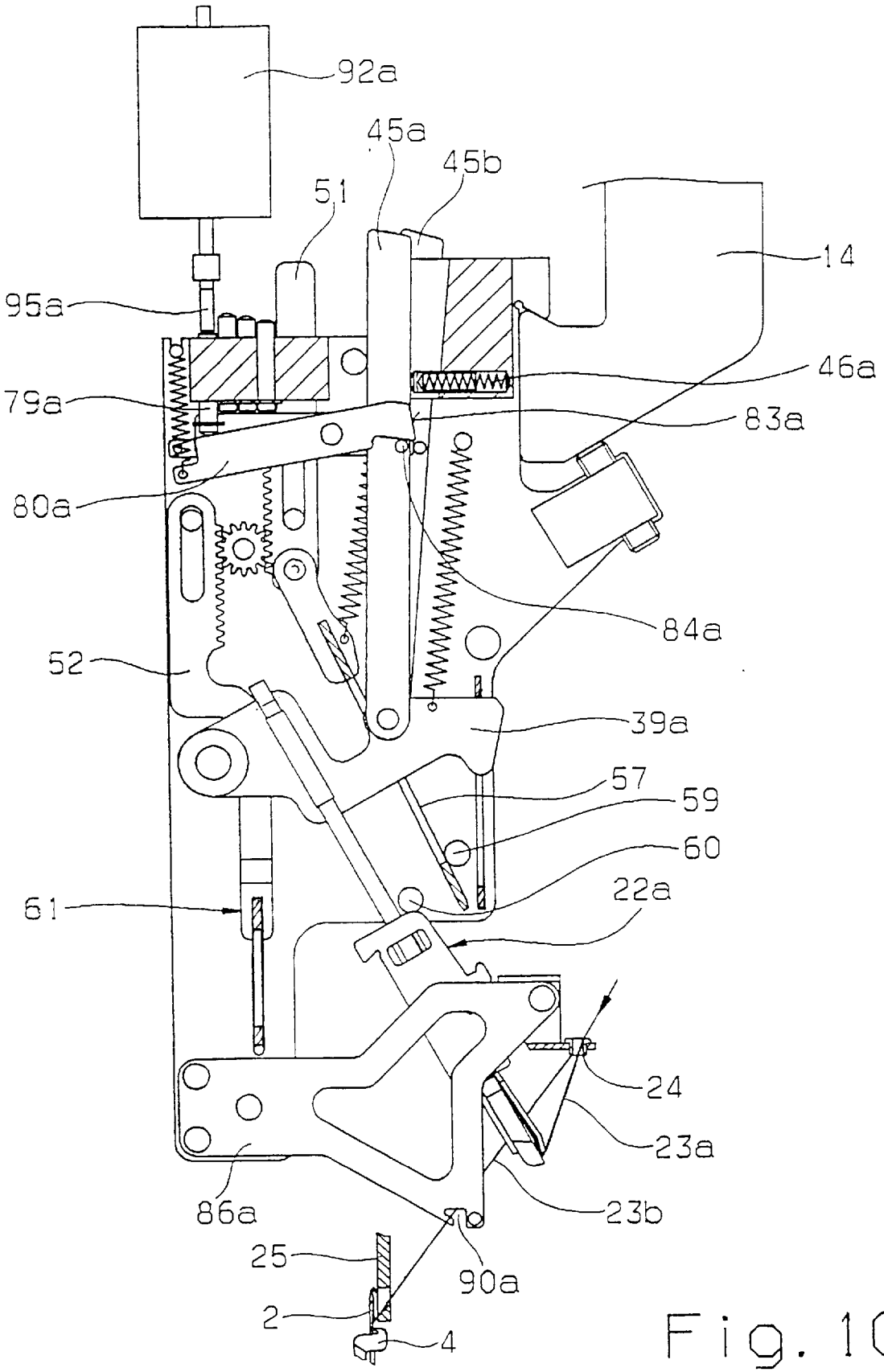
FIGS. 10 to 14 are views corresponding to FIG. 4 showing the manner of operation of the yarn changer according to the invention.

According to FIGS. 5 to 9, each yarn finger 22 includes a straight, rod-shaped finger body 65, which is fixed at its upper end in FIGS. 5 to 9 on to the associated pivoted lever 39. A guide body 66 is slidably guided on each finger body 65. The finger body 65 has a U-shaped recess 67 at its lower end, through which the yarn 23 (FIGS. 1, 6 and 9) can run and whose lower edge is formed as a cutting edge 68 (FIG. 5). The guide body 66 carries a cutting element 69 which cooperates with the cutting edge 68 on one side of the finger body 65 and, on the other side, a clamp element 71 which is pressed against the finger body 65 by a pressure spring 70. The guide body 66 consists for example of a hollow block receiving the finger body 65 with sliding fit and which has window-like openings 72 in its front and rear walls, which serve to receive projections 73, 74 and 75 in interlocking manner, these projecting perpendicularly from the upper ends of the cutting and clamping elements 69, 71 and the pressure spring 70. This provides simple assembly of the various parts and reliable entrainment of the cutting and clamping elements 69, 71. Moreover the guide body 66 has a projection 76 on the side associated with the cutting element 69, this projection cooperating with the bar 63 of the opener 61 (FIG. 4) and has a projection on its side associated with the clamping element 71, this projection cooperating with the closer 57.

Moreover it is clear that the yarn changer 21 according to FIGS. 3 to 9 has as many yarn fingers 22 and selector levers 45 arranged side by side as there are different yarns 23 to be fed. In the embodiment there are four each of the yarn fingers 22 and selector levers 45 but it is self-evident that more or less yarn fingers 22 and selector levers 45 could be provided.

A guide body 78 (FIG. 4) is fitted on the upper end of the housing of the yarn changer, between the two side plates 27 and 28, four control pins 79 being guided therein with a sliding fit parallel to the longitudinal axis 37. The guide body 78 moreover serves to support the upper part of the control member 51 slidably. The control pins 79 abut four associated pre-selector levers 80 respectively, which are pivotally mounted on a further stud 81 extending between the side plates 27, 28 and extend in FIG. 4 substantially horizontally, i.e. perpendicular to the selector levers 45. The pre-selector levers 80 are biased clockwise into a datum position by springs 82 engaging their rear ends and are held in abutment with the lower ends of the associated control pins 79 projecting out of the guide body 78, the upper ends of the pins projecting upwardly out of the guide body 78.

The front ends 83 of the pre-selector levers 80 bear in their datum position on stop pins 84) which are fixed on the associated selector levers 45 and project to the sides of these, so that they are retained in the datum position seen in FIG. 4 against the force of the springs 46.

As FIGS. 3 and 4 show, the described parts of the yarn changer preferable consist of stampings which are made out of comparatively thin sheet metal. The wide sides of the levers 39, 45, 80 etc. and the sliders 51, 52 lie parallel to the side plates 27 and 28, so that all parts associated with each yarn finger 22 lie directly beside or over one another and form a sub-assembly which serves for selection of a yarn 23. On the other hand the parts 48, 51, 52, 55, 57 and 61 are only provided once and are associated in common with all sub-assemblies. It is thus possible to make a very space-saving, compact yam changer, which makes it possible to fit e.g. 48 yarn changers 21 round the periphery of a conventional 30" circular knitting machine.

A number of guide laminae 86 are arranged in the lower part of the housing according to FIGS. 3 and 4, between and parallel to the side plates 27 and 28, being fixed and held spaced from one another by studs 87, 88 and 89 passing therethrough and spacers 36 fitted on the studs. These guide laminae 86 provide lateral guidance for the yarn fingers 22, largely free from wobble even with larger tolerances, during their pivotal movements, and can if required be provided with lower recesses 90 in which lie the yarns 23 just being worked handled by the circular knitting machine.

As shown in FIGS. 1 and 2 in particular, a selector apparatus 91 is mounted on the support ring 16; it has a number of control magnets 92 corresponding to the number of yam fingers 22 and control pins 79 and arranged offset in the radial direction in correspondence with the control pins 79. The control magnets 92 are in the form of solenoids and are each provided with a horizontally and radially reciprocating plunger 93, which is articulated to a lever 94, which projects through a recess, not shown specifically, into a region arranged below the support ring 16, and there carries a control cam 95 and is pivotally mounted in a middle part by means of a pin 96 foxed on the support ring 16. The control cam 95 is arranged in the radial direction e.g. with the plunger 93 extended, above and in the working range of an associated control pin 79 and with the plunger 93 retracted outside the working range of the associated control pin 79. The arrangement can naturally be inverted so that only retracted plungers 93 act on the control pins 79. Accordingly, with rotation of the support ring 16 together with the needle cylinder 1 in the direction an arrow v (FIG. 2), only those control cams 95 come into the working range of associated control pins 79 as are selected by appropriate control of the control magnets 92. The current supply to the control magnets is effected by means of conductors 97, which are fed in a manner known per se from a pattern device, not shown, via slip rings 98, which extend coaxially round the axis of rotation 26 in the centre of the circular knitting machine and are sensed by sliding brushes 99 connected to the conductors 97. Moreover it is possible to arrange the individual magnets 92 one after the other in the peripheral direction in accordance with FIG. 2, in which case the control signals have to be applied with a corresponding offset in time.

Furthermore, FIG. 2 in particular shows three cam tracks 101, 102 and 103, which are fitted on the underside of the support ring 16. The leading end of the cam track 101, in the direction of rotation (arrow v), which however trails behind the selector apparatus 91, is associated with the selector levers 45 (FIG. 4), the subsequently beginning cam track 102 with the control member 51 and the last cam track 103 also with the selector levers 45.

Finally, a yarn catcher 104 fixed on the support ring 16 is shown schematically in FIG. 2 and serves in a manner known per se to engage the yarn 23 offered by a selected yam finger 22 above a bar 25*a* and lay it safely into a slot 105 (FIG. 3) of the yam guide 25 formed behind the bar 25*a*. As shown especially in FIG. 1, the yarn catcher 104 is fixed on an arm 106 connected to the support ring 16 and is held closely above and behind the hooks of the knitting implements 2.

The manner of operation of the circular knitting machine and yarn changer described with reference to FIGS. 1 to 9 will now be explained in more detail with reference to FIGS. 10 to 14, wherein parts additionally provided with the letter "a" are associated with a yarn 23*a* to be newly laid in and the parts additionally provided with the letter "b" are associated with an old yarn 23*b* still being worked.

In FIGS. 3 and 4 it is assumed that the yarn 23*b* among the four yarns 23*a*, 23*b*, 23*c* and 23*d* in all is being knitted and laid into the hooks of the knitting implements 2. Therefore, the yarn 23*b* lies according to FIG. 4 (cf. also FIG. 6) in the open recess 67 of a masked yarn finger 22 and in the recess 90 of the associated guide lamina 86. All other yarns assume the same clamped position as the yarn 23*a* in FIG. 4 (cf. also FIG. 9).

When a yarn change to e.g. the yarn 23*a* is to be made, the associated control magnet 92*a* (FIG. 10) is firstly controlled during the rotation of the support ring 16 and thus the control cam 95*a* coupled thereto is arranged above the associated control pin 79*a*. The result of this is that, with further rotation of the support ring 16, the control pin 79*a* is gradually pushed down by a falling surface of the control cam 95*a* and the associated pre-selector lever 80*a* is swung anticlockwise into a pre-selection position and its end 83*a* is raised from the stop pin 84*a* of the associated selector lever 45*a*. The spring 46*a* thus becomes active and swings the selector lever 45*a* anticlockwise so far into an operating position that its upper end is offset radially inwardly from the upper ends of the other selector levers 45*b* etc. and is arranged above the housing in the region of the cam track 101 (FIG. 2). The selection of the yarn 23*a* is thus prepared for and the associated control magnet 92*a* can change over its signal in order to make the following yarn changer in the direction of the arrow v operative. The pre-selection position is moreover held by the spring 46*a*.

Figure 11:
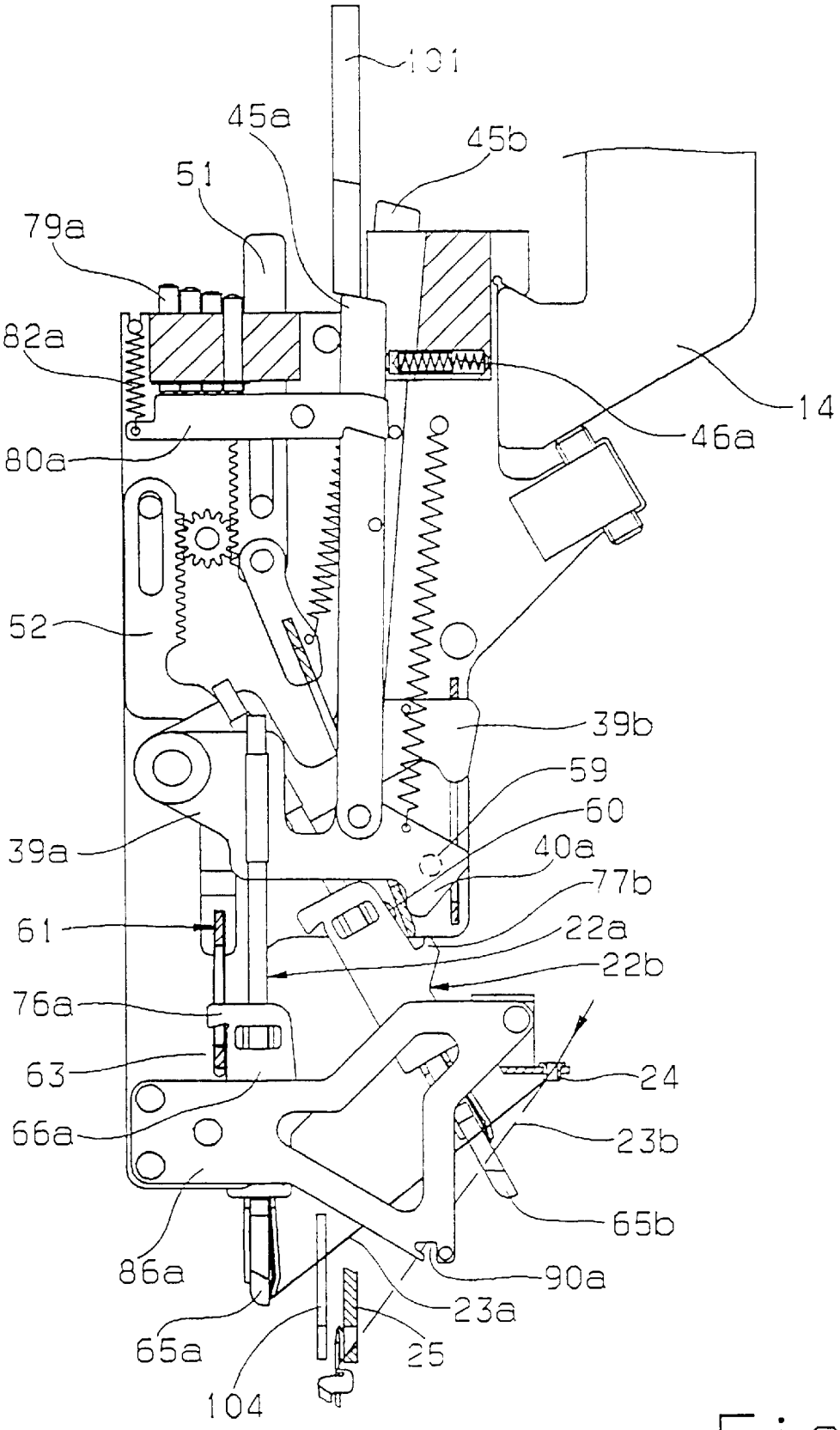

FIG. 11 shows that, with further rotation of the support ring 16, a downwardly rising section of the cam track 101 acts on the selector lever 45*a* located in the working position and presses this down. The actual yarn change is thereby initiated, in that on the one hand the associated yarn finger 22*a* is swung clockwise by the pivoted lever 39*a* and on the other hand the pre-selector lever 80*a* and the control pin 79*a* therewith are restored to the datum position by the spring 82*a*. The swinging of the yarn finger 22*a* results in the lower end of the associated finger body 65*a* being swung from a radially outward datum position relative to the knitting implements 2 into a working position radially behind the backs and directly over hooks of the knitting implements 2. The old finger body 65*a* guiding the old yarn 23*b* is also visible in FIG. 11. Through the swinging of the pivoted lever 39*a* its nose 40*a* is at the same time applied against a lower transverse web of the closer 57, whereby this is lifted off the abutment 59 and applied against the abutment 60. In this position the lower, free end of the closer 57 is located directly opposite the projection 77*b* of the guide body 66*b*. At the same time the yarn finger 22*a* is substantially vertical and so arranged that the bar 63 of the opener 61 is arranged directly under its projection 76*a*. The yam catcher 104 is already arranged directly in front of the yarn 23*a*.

Figure 12:
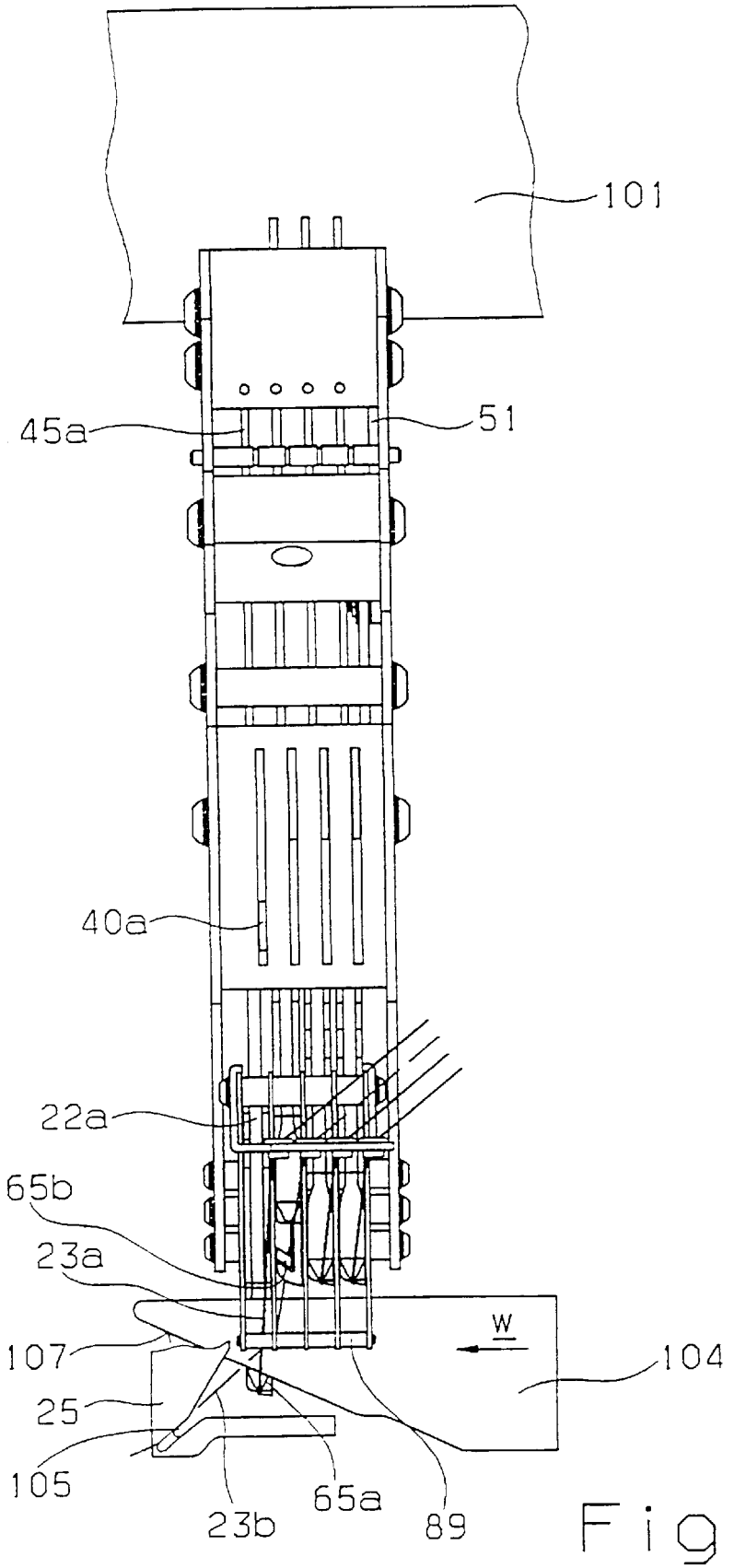

According to FIGS. 2 and 12, with further rotation of the support ring 16 in the direction of an arrow w (FIG. 12), the yarn catcher 104 now comes ever further into a position in which it engages the yarn 23*a* held and offered up by the yam finger 22*a* and with a falling curve 107 presses it deeper into the V-shaped slot 105 of the yarn guide 25, so that it can, like the yarn 23*b* be engaged by the hooks of the raised knitting implements 2. Accordingly both yarns 23*a* and 23*b* are knitted together in the region of a so-called change point. The yarn finger 22*a* is still held by the cam track 101 in the position seen in FIGS. 11 and 12.

Figure 13:
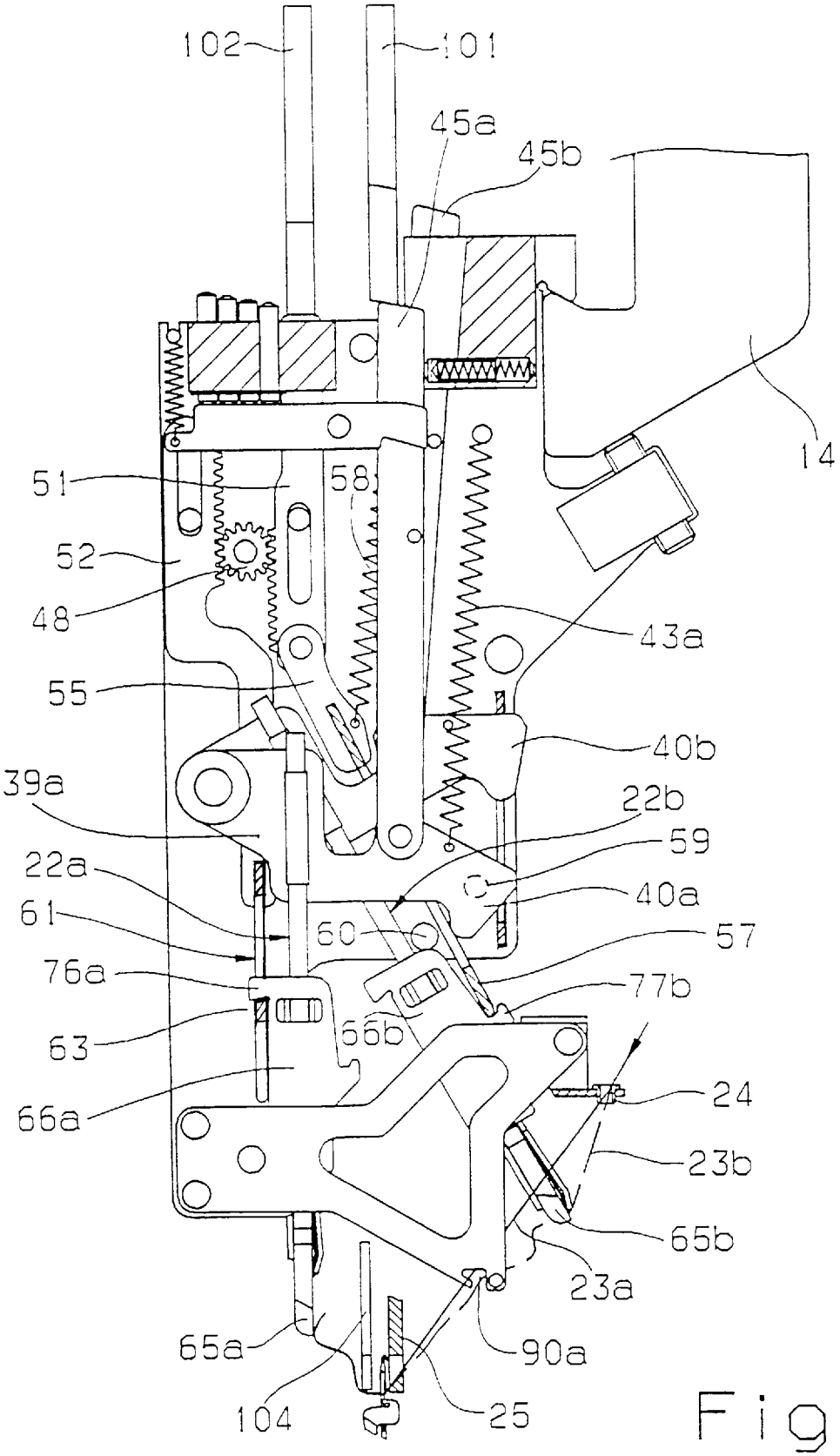

With further rotation of the support ring 16, the cam track 102 comes gradually into the region of the upper end of the control member 51, so that this is pressed down in FIG. 13 together with the closer 57 by a falling section of the cam track 102 and at the same time the slider 52 with the opener 61 is pulled up through the reverse-coupling mechanism 48 to 54. Through this on the one hand the guide body 66*b* of the yarn finger 22*b* is moved by means of the closer 57 acting on the projection 77*b* in the direction of the free end of the finger body 65*b* and the yarn 23*b* is thus cut and clamped (cf. also FIG. 9). On the other hand the guide body 66*a* of the yarn finger 22*a* is pushed up by the bar 63 of the opener 61 engaging under the projection 76*a* of the guide body 66*a* and the clamped end of the yarn 23*a* is thus released. The yarn change is thereby concluded and it is now the yarn 23*a* which is knitted. By suitable determination of the spacing of the closer 57 and the bar 63 from the associated projections 77*b* and 76*a* in the position seen in FIG. 11 the precise point in time at which the yarn in question is to be clamped and released respectively can be determined.

Figure 14:
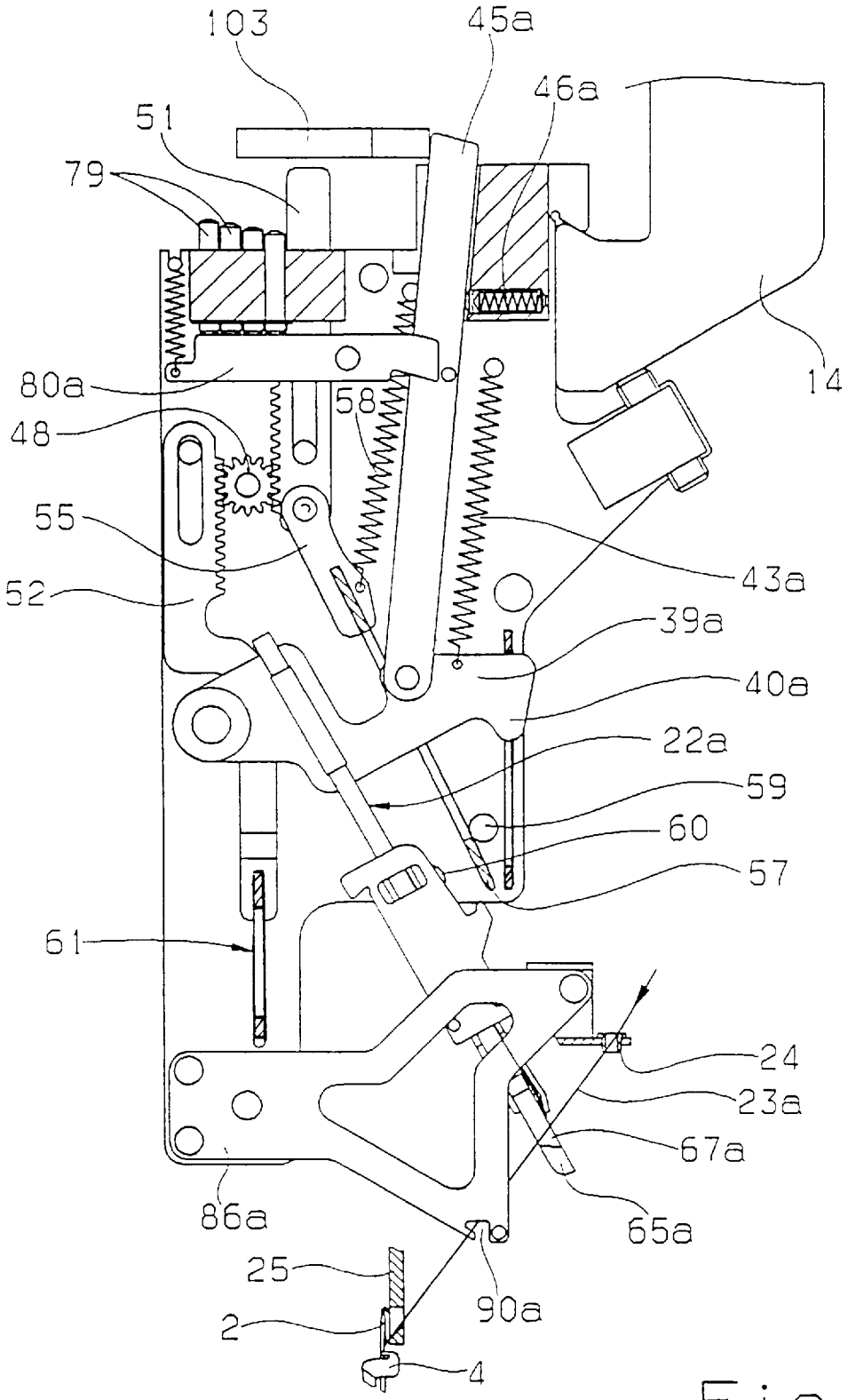

With further rotation of the support ring 16, the end of the cam track 102 is reached next according to FIG. 2, whereby the control member 51 and the slider 52 are moved back under the action of the spring 58 into their datum position according to FIG. 4 or 14 and at the same time the closer 57 is swung back from the stop 60 to the stop 59. Then the end of the cam track 101 is also reached (FIG. 2), so that the pivoted lever 39*a* and the selector lever 45*a* are swung back into the datum position according to FIG. 10 under the action of the spring 43*a*.

Finally the cam track 103 (FIGS. 2 and 14) comes into the region of the upper end of the selector lever 45*a* and acts radially outwards thereon. The selector lever 45*a* is thereby swung back into the datum position against the pressure of the spring 46*a*, so that its stop pin 84*a* latches behind the end 83*a*, so that the starting condition of all parts is produced again.

As FIG. 2 shows, the yarn change initiated by the selector apparatus 91 and carried out by the active sections of the cam track 102 and of the yarn catcher 104 can be effected within a region extending over a few knitting implements 2, the so-called change point, while the whole control region from the beginning of the selector apparatus 91 to the end of the cam track 103 can extend over a comparatively large region of e.g. half a revolution of the needle cylinder.

It is preferable that, under the action of the yam catcher 104 (FIGS. 12, 13, 14), the newly laid in yarn 23*a* is pressed so deeply into the slot 105 of the yarn guide 25 that a yarn section located between this and the run-in eye 24 enters the recess 90*a* of the associated guide lamina 86*a*. The yarn 23*a* is thus so guided that it enters into the opened recess 67*a* of its finger body 65*a* when the yarn finger 22*a* (FIG. 14) swings back and it is thus securely clamped and cut in the next yarn change.

Figure 15:
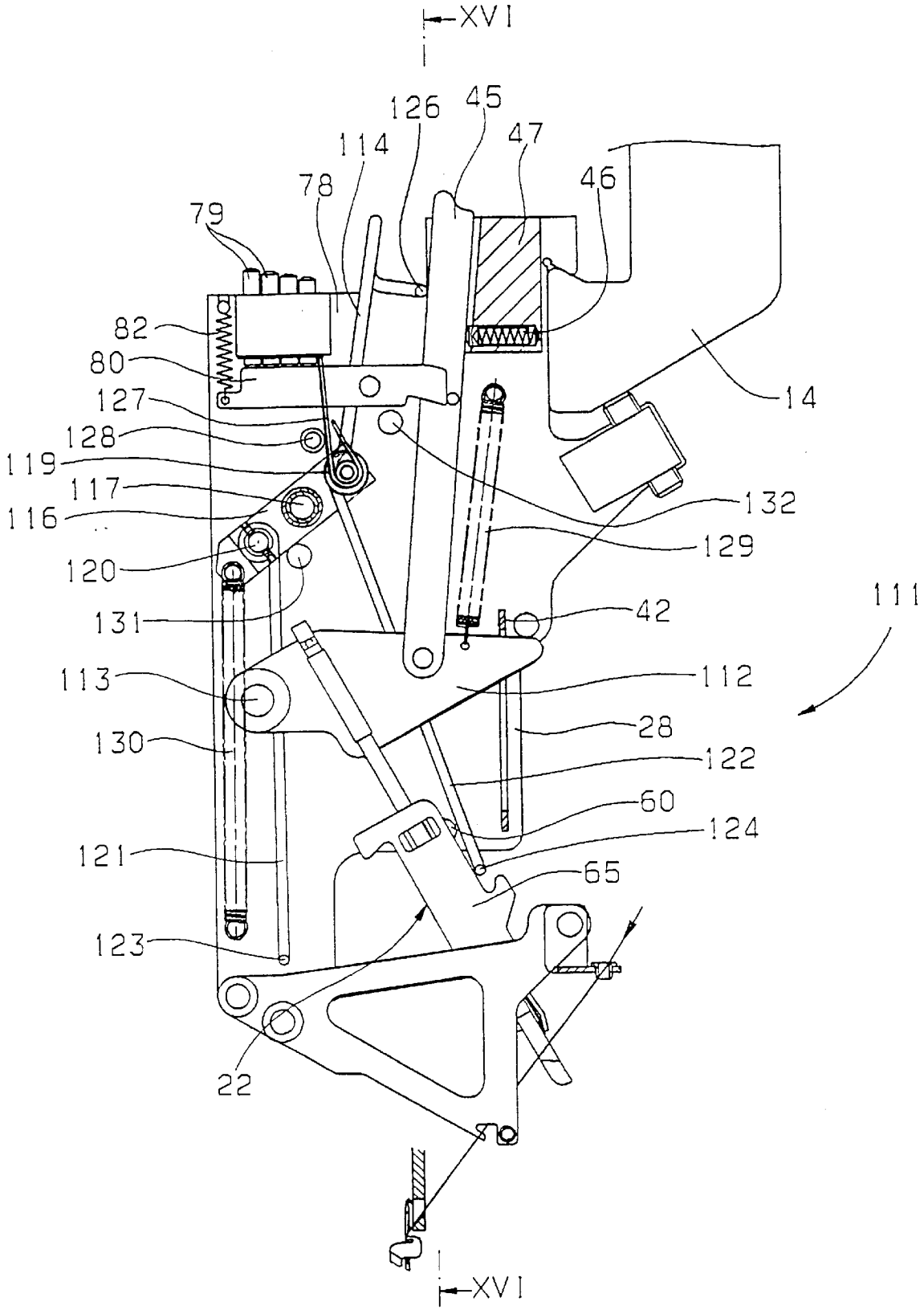
Figure 16:
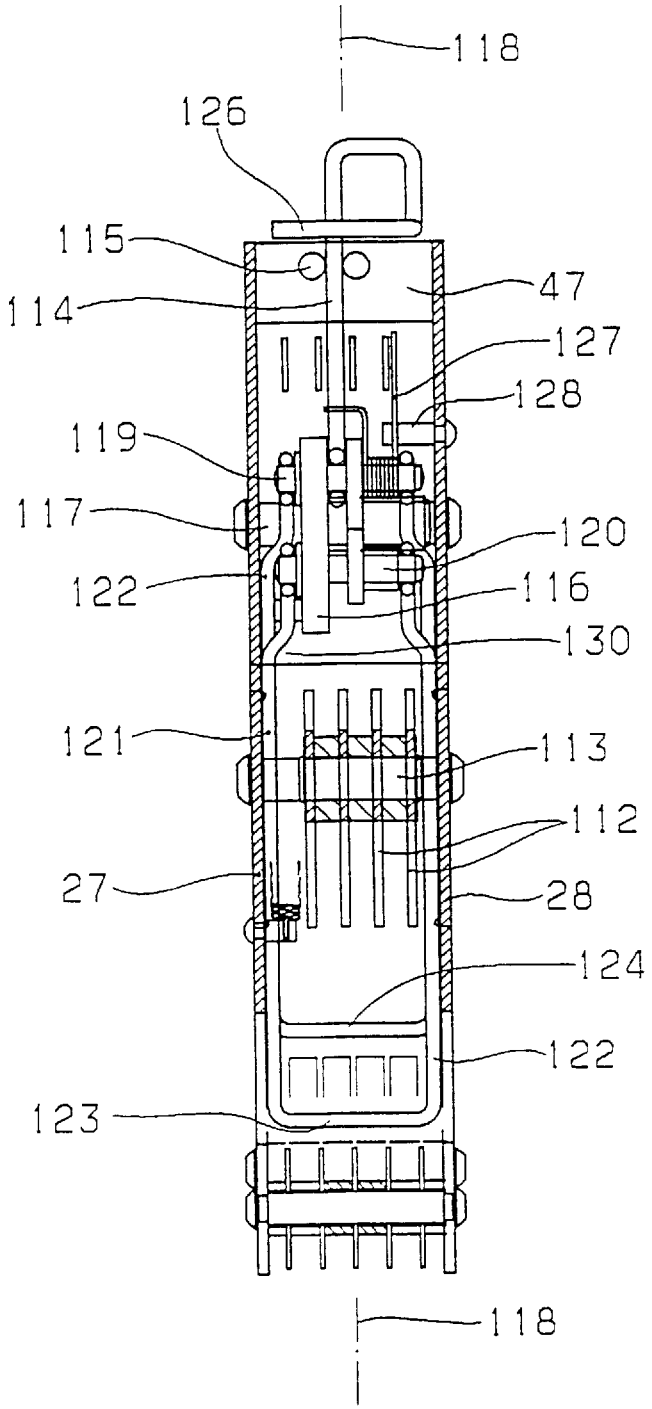
Figure 17:
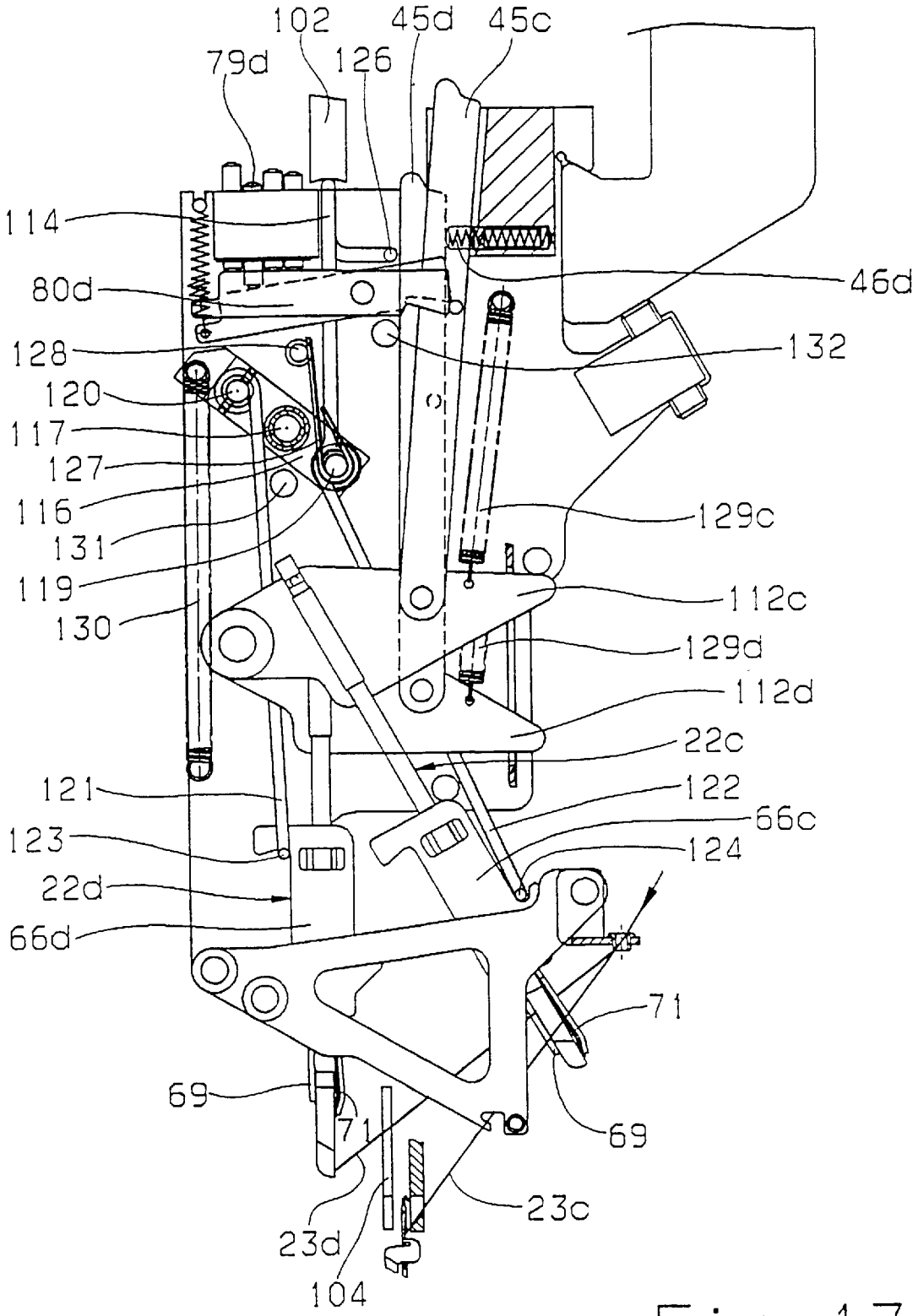

FIGS. 15 to 17 show a second embodiment of a yarn changer 111 according to the invention at present believed to be the best, which corresponds in its construction and in its function essentially to the yarn changer 21 according to FIGS. 1 to 14, so that like parts are given the same reference numerals in FIGS. 15 and 17 and only the parts which are different are described below.

In the datum position of the parts seen in FIGS. 15 and 16, the selector levers 45 are articulated to single armed pivoted levers 112 which are the same as the pivoted levers 39 apart from omission of the noses 40, are fixed to the yarn fingers 22 and fit on a stud 113 arranged transversely between the side plates 27, 28 (FIG. 16). Instead of the reverse-coupling mechanism according to FIGS. 1 to 14 a reverse-coupling mechanism is provided which includes a control member 114 which consists of a bent wire or pivoted bow for example, which is so pivotally mounted within an upper, middle housing part between two studs 115 (FIG. 6) mounted in the guide body 78 that it does not interfere with the movements of the other parts. A two-armed lever 116 serves for the pivotal mounting of the control member 114 (FIGS. 15, 16), and is pivotally mounted in a middle part on a stud 117, which is arranged transverse to the longitudinal axis 118 of the housing and perpendicular to the side plates 27, 28 and is fixed to these. The lever 116 carries a pin 119 at one end, on which an eye formed at the lower end of the pivoted bow 114 fits rotatably and carries a pin 120 at the other end, on which an opener 121 is rotatably mounted. A closer 122 is moreover pivotally mounted on a the pin 119. The reverse-coupling mechanism is thus formed by the parts 114 to 120 in this embodiment. The opener 121 and the closer 122 each consist in this embodiment in a rectangularly bent wire, whose two ends are each bent into an eye rotatably mounted on the pin 119 or 120 and whose long arms are arranged parallel to the side plates 27, 28 and to the longitudinal axis 118. Lower transverse webs 123 and 124 respectively of the opener 121 and closer 122 extend over substantially the whole width of the housing and correspond to the bar 63 and the lower bounding edge of the closer 57 respectively (FIG. 4).

The upper end of the control member 114 is so bent into a hook shape that it forms an entraining arm 126, which extends in accordance with FIG. 16 transversely over the width of the housing and bears on the upper edges of all the selector levers 45 in a datum position. In order to assist this operation, a helical spring is fitted over the stud 119 and one end thereof bears on a pin 128 and the other end on the control member 114 in such a way that its entraining arm 126 is pressed against the upper ends of the selector levers 45.

The datum position of the parts seen in FIGS. 15, 16 is, as in FIG. 4, ensured by springs 129, 130, which so pull the pivoted levers 112 against the upper edges of the plate 42 and the two-armed levers 116 against a stop 131 that the opener 121 assumes its lowest position and the closer 122 its highest position.

The arrangement otherwise corresponds essentially to FIGS. 1 to 14.

The manner of operation of the yarn changer 111 according to FIGS. 15 and 16 appears especially from FIG. 17, in which an older, knitting yarn 23*c* is to be replaced by a new yarn 23*d* and in which the parts associated with the yarn 23*c* are additionally given the letter "c" and the parts associated with the yarn 23*d* are additionally give the letter "d".

As in FIGS. 1 to 14 a control pin 79*d*, and with it a pre-selector lever 80*d*, are actuated by means of a selector apparatus, not shown but preferably corresponding to the selector apparatus 91 (FIG. 1), whereby the associated selector lever 45*d* is applied against a stop 132 by the spring 46*d*. The selector lever 45*d* carries the entraining arm 126 with its and thus swings the control member 114 against the force of the helical spring 127 in the anticlockwise sense, into an operating position such that its upper end projects upwardly out of the housing and comes into the region of the cam track 102 (cf. also FIG. 13).

After the selector lever 45*d*, the pivoted lever 112*d* and the associated yarn finger 22*d* have been swung as in FIGS. 11 and 12 by the cam track 101, the cam track 102 acts on the control member 114 and presses this substantially vertically down. The two-armed lever 116 is thereby swung clockwise through about 90°, until it bears at another side on the stop 131 again (cf. FIGS. 15 and 17). This results on the one hand in the opener 121 being raised with the guide body 66*d* and, on the other hand, the closer 122 being lowered and with it the guide body 66*c*, in order to free and cut and clamp the yams 23*d* and 23*c* respectively in the manner described with reference to FIGS. 5 to 14. After the track 103 has passed by (FIG. 14) all parts are swung back into the datum position according to FIG. 15 by the springs 129*d*, 130 and 127.

A substantial advantage of the embodiment described with reference to FIGS. 15 to 17 lies in that, with the selector levers 45 in the datum position (FIG. 15), the control member 114 also assumes a datum position, in which its upper end is arranged out of the range of the track 102. The opener 121 and closer 122 of all yarn changers present therefore remain unaffected thereby so long as no yarn change takes place. On the contrary, the track 102 operates on the control member 51 in every revolution of the needle cylinder 1 in the embodiment according to FIGS. 1 to 14, so that the opener and closer 61, 57 execute a dead stroke in every needle cylinder revolution in which no yarn change is desired. This leads to increased wear and especially to greater creation of noise. In using the embodiment according to FIGS. 15 to 17 the creation of noise is minimal, since when no yarn change is effected, all parts stay at rest until a new yarn change is to be initiated.

A further substantial advantage of the yarn changers 21 and 111 is to be seen in that the selector levers 45 and control members 51 and 114 respectively to be actuated by the cam tracks 101, 102 and 103 act directly and not through additional levers or the like on the associated functional parts (yarn fingers 22, closers 57 or 122, openers 61 or 121). The working direction of the parts 45, 51 and 114 is preferably parallel to the longitudinal axis 37 or 118. In this way the total number of parts present is substantially reduced. Moreover, increased operating reliability results. Finally it is possible to make the whole yarn changer 21 or 111 very compact and narrow, so that more yarn changers can be arranged round the circumference of an ordinary circular knitting machine that heretofore.

A further substantial advantage of the yarn changers 21 and 111 according to the invention consists in that these are on the one hand arranged substantially above the circle of the knitting implements 2 and on the other hand are controlled by cam tracks 101, 102 and 103 which run above the housings of the yarn changers 21, 111. Accordingly there is enough space available on the circular knitting machine for the yarn changers 21, 111 not only to leave the working region of the circular knitting machine largely free but they can be used directly even with circular knitting machines which have a dial 134 schematically indicated in FIGS. 18 to 20, rotating together with the needle cylinder 1, instead of the sinker ring 3. The drive shaft 12 is guided above the pinion 17 by a stationary support disc 135 and provided with a further pinion 136 which is in mesh with a drive gearwheel 137, which is fixed on a further drive shaft 138 rotatably mounted in the centre of the circular knitting machine, coaxial with the axis of rotation 26. This drive shaft carries a support ring 139 in usual manner at its lower end, on which in mounted the dial 134, while the support disc 135 supports a carrier 140 for a conventional dial cam box 141.

Figure 18:
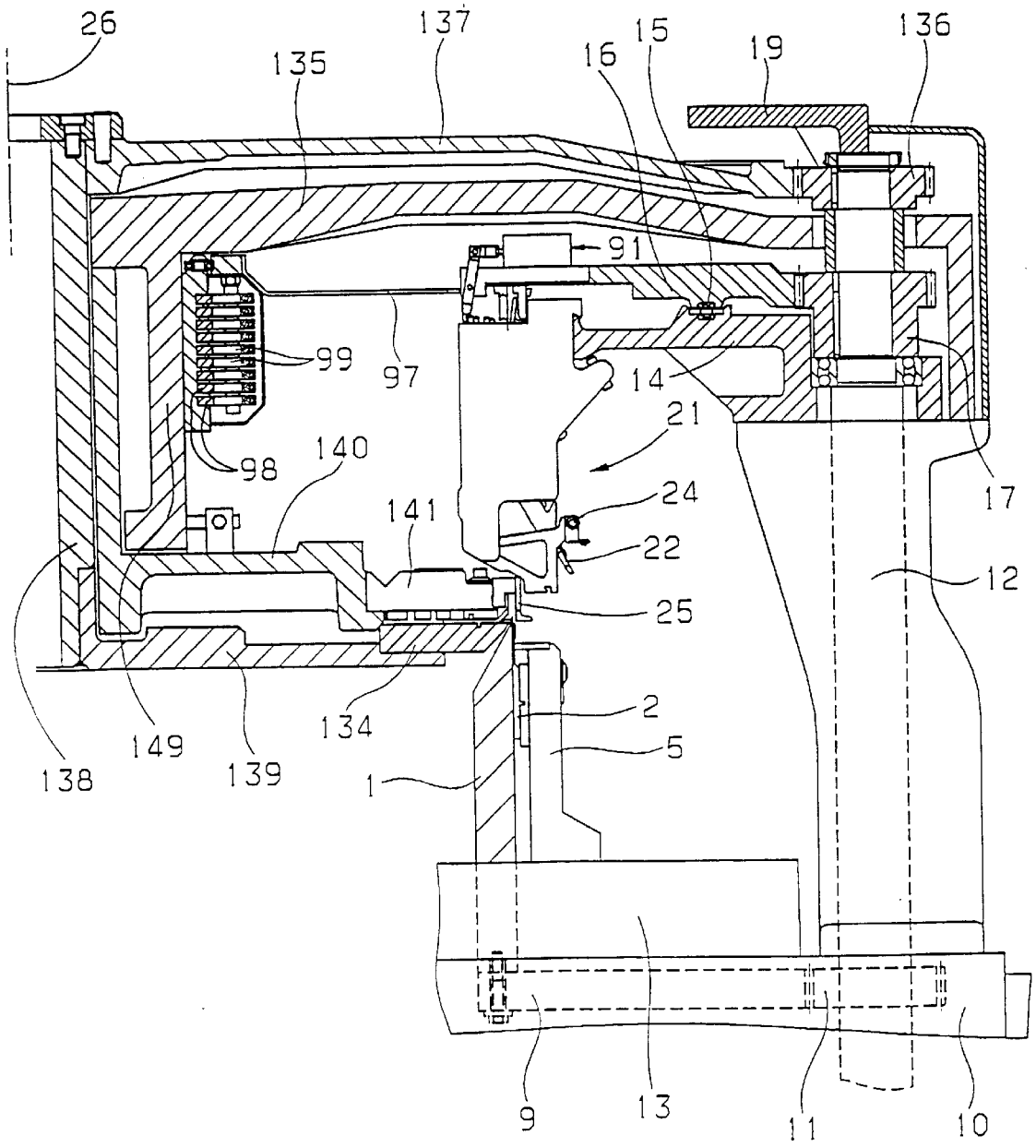
FIG. 18 is a view corresponding to FIG. 1 of a rib circular knitting machine in accordance with the invention.
Figure 19:
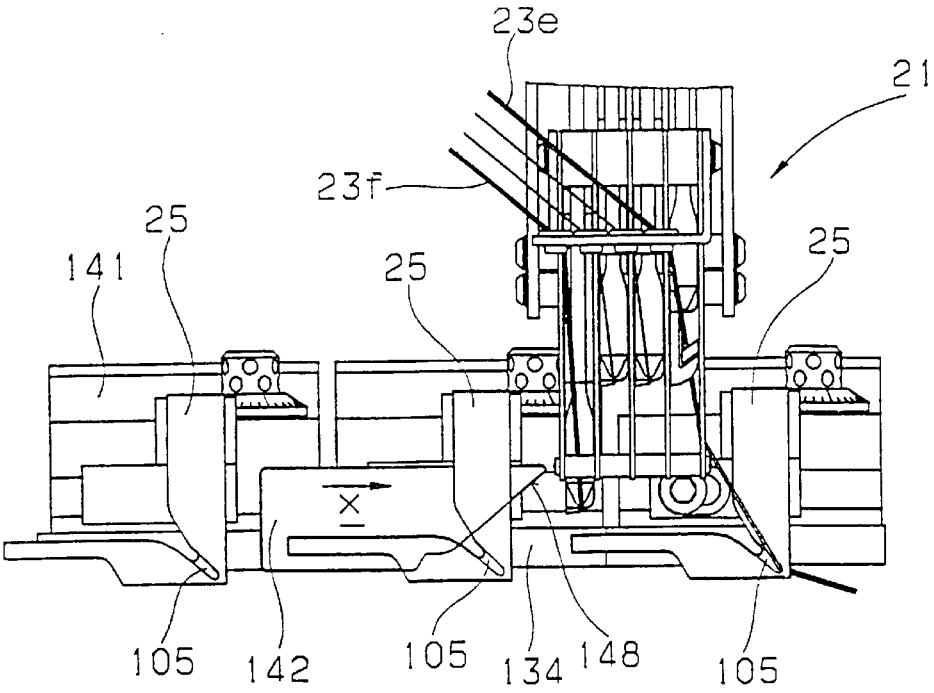
FIG. 19 is a schematic front view of the rib circular knitting machine according to FIG. 18 in the region of the dial.
Figure 20:
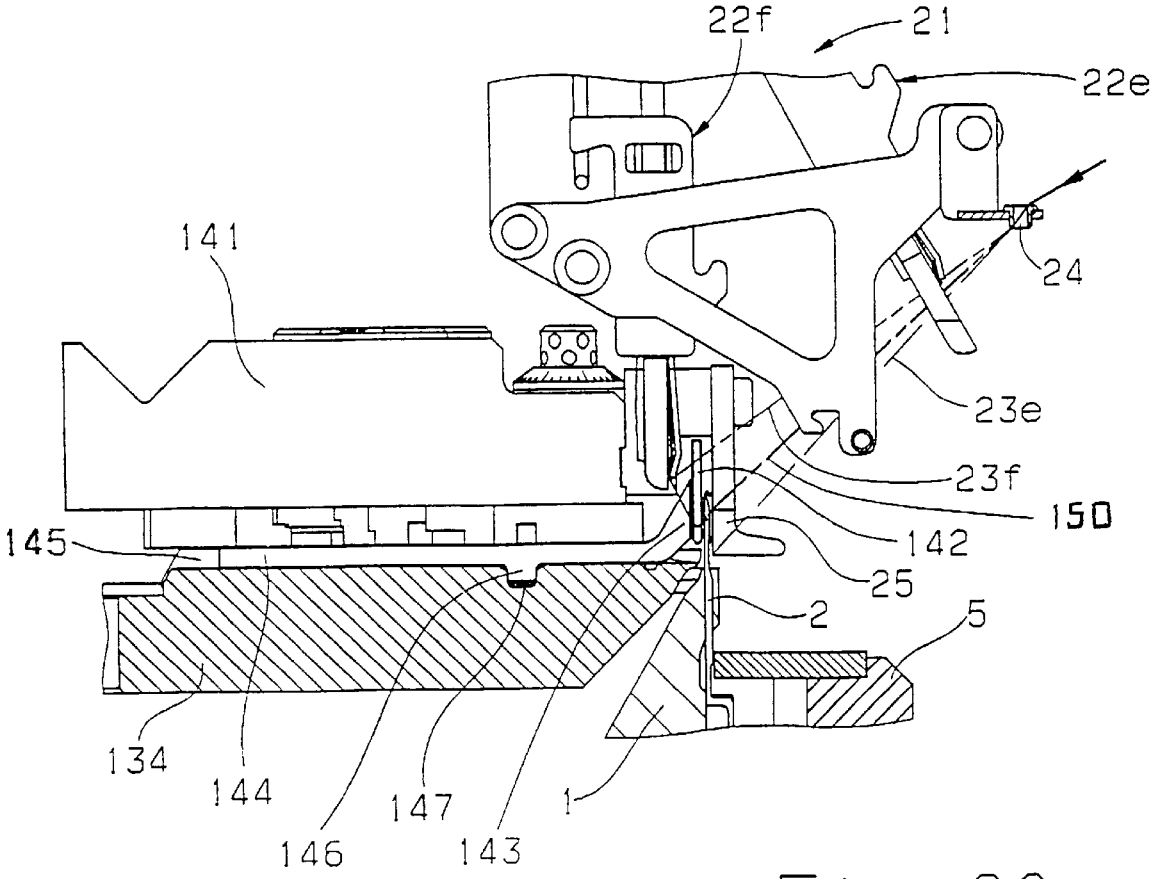
FIG. 20 is a radial, vertical section through the circular knitting machine of FIG. 18 in the region of the dial.

In contrast to FIGS. 1 to 17, a yarn catcher 142 is integrated in the dial 134 in the embodiment according to FIGS. 18 to 20, since the space in which the radially inwardly arranged arm 106 otherwise runs (FIG. 1) is here at least partially occupied by the dial cam box 141, so that the arm 106 would have to be shaped in a special way dependent on the specific type of machine, in order to be able to pass the yarn catcher 142 without hindrance behind the knitting implements 2. Through the variant according to the invention the yarn catcher 142 can be mounted without such an arm 106. As shown particularly by FIG. 20, the yarn catcher 142 is fixed on a rearward retaining plate 143, on the rear side of which at least one mounting bar 144 is fixed. There are preferable a plurality of such mounting bars 144. These consist of long, flat parts like the shank of a needle or a jack selector and are mounted in place of a corresponding number of dial needles in the radial grooves 145 of the dial 134 receiving these. The mounting bars 144 moreover each have a downwardly projecting butt 146. These butts 146 are arranged in a groove 147 running in a circumferential direction, in order to prevent radial movements of the mounting bars 144. The groove 147 is only formed in the region of the change point, where the mounting bars 144 are to lie. In this manner it is possible to arrange the yarn catcher 142 closely behind those hooks of the knitting implements 2 of the needle cylinder 1 in which the old and new yarns 23 are laid in the region of the change point.

FIG. 19 further shows a front view of three knitting systems lying adjacent one another, each with a yarn guide 25 having the slot 105, where a yarn changer 21 is shown schematically only in the knitting system farthest to the right. This feeds a yarn 23*e* shown with exaggerated thickness, which is arranged in the slot 105 of the associated yarn guide 25. Moreover, a yarn finger 22*f* (FIG. 20) is swung into its working position, in which it offers a new yarn 23*f*, also shown with exaggerated thickness, in the described manner. This is then engaged by the yarn catcher 142 mounted on the dial or its obliquely extending curve 148 (FIG. 19) arranged in FIG. 19 directly in the middle knitting system and moving in the direction of an arrow x and is gradually laid into the slot 105 of the yarn guide 25, as is indicated in FIG. 20 by broken line 150 between the yams 23*e*, 23*f* and as fully explained with reference to FIGS. 5 to 14.

FIG. 18 further shows the slip rings 98 indicated also in FIG. 2, mounted on an outer wall of a sleeve 149 surrounding the drive shaft 138 and connected to the support disc 135, as well as the brushes 99 and the conductors 97 which lead to the control magnets 92.

The invention is not limited to the described embodiments, which can be modified in many ways. This applies in particular to the various parts of the yarn changers 21 and 111. For example, the closer 57 could be in the form of an L or U-shaped bow, like the closer 122. It would also be possible to fit the parts 51, 52 on both side plates 27, 28, to mount them on the studs 53, 54 and couple them by gearwheels 48 fitted on both sides. In addition reverse-coupling mechanisms of different forms could be provided and also the control members 51 could be so designed and arranged that they are only arranged in the working range of the track 102 when a yam change is desired. Furthermore, it is possible to mount the opener and/or closer adjustably on the parts 52. 55 or 116, e.g. with the aid of slots, adjusting screws, eccentrics, or the like in order to be able to adjust the point in time at which they become active. It is further obvious that other, in particular mechanical pattern devices could be provided in place of the selector magnets 92. Moreover the described parts can be provided in combinations other than those shown. Finally the invention is not limited to circular knitting machines but can also be used with flat-bed knitting machines with suitable modifications.

While the invention has been illustrated and described as embodied in a knitting, it is not intended to be limited to the details shown, since various modifications and structural changes may be made without departing in any way from the spirit of the present invention, particularly with respect to other textile machines.

Without further analysis, the foregoing will so fully reveal the gist of the present invention, that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A circular knitting machine comprising a needle cylinder and a dial for movably receiving knitting implements; a support for a dial cam box arranged above the dial; a dial driver means arranged above the support; at least one yarn changer; a selector apparatus for said yarn changer; cam tracks for actuating functional parts of said yarn changer; a further support for mounting said yarn changer; and a support ring rotatable relative to said further support for mounting said selector apparatus; said further support and said support ring being arranged between said support and said dial cam box and said support ring being arranged above said further support.

2. A circular knitting machine according to claim 1, wherein a yarn catcher is associated with said yarn changer and is fixed on at least one mounting bar which is mounted instead of a knitting implement in a groove of the dial provided therefor.

3. A circular knitting machine according to claim 1, wherein said cam tracks are mounted on the support ring.

* * * * *